United States Patent [19]

Melnyk et al.

[11] Patent Number: 4,546,825

[45] Date of Patent: Oct. 15, 1985

[54] HEAT EXCHANGER AND METHOD OF ASSEMBLY THEREOF

[75] Inventors: William Melnyk, Lathrup Village, Mich.; Norman J. Kaarre, Canton, S. Dak.

[73] Assignee: McCord Heat Transfer Corporation, Walled Lake, Mich.

[21] Appl. No.: 461,773

[22] Filed: Jan. 28, 1983

[51] Int. Cl.[4] ..... F28D 7/00; F28F 9/22; F28F 9/02

[52] U.S. Cl. ..... 165/159; 165/158; 165/916; 29/157.3 R; 29/157.4

[58] Field of Search ..... 165/160, 161, 159, 158, 165/DIG. 23; 29/157.3 R, 157.4

[56] References Cited

U.S. PATENT DOCUMENTS

| | | | |
|---|---|---|---|
| 382,546 | 5/1888 | Moore | 165/161 |
| 1,955,006 | 4/1934 | Mateer et al. | 165/160 |
| 3,240,267 | 3/1966 | Edberg | 165/159 |
| 3,739,443 | 6/1973 | Friedman | 165/159 |

FOREIGN PATENT DOCUMENTS

| | | | |
|---|---|---|---|
| 1124230 | 5/1982 | Canada | 165/159 |
| 756214 | 8/1956 | United Kingdom | 165/159 |
| 757633 | 9/1956 | United Kingdom | 165/159 |

*Primary Examiner*—William R. Cline
*Assistant Examiner*—John K. Ford

[57] ABSTRACT

The drawings and description disclose a heat exchanger including two half circle shells, each having corrugated walls, with the half circle shells being welded together at their mating edges to form a full round shell. Prior to the welding operation, a perforated header is mounted in the half shells in the first corrugation adjacent each end thereof, and a plurality of perforated baffles are mounted within the half shells intermediate the headers in corrugations at alternate equally spaced intervals therein. The perforations in the headers and baffles are formed to be aligned, and a tube is mounted through each series of aligned openings to form a tube bundle within the half shells. The two half shells are welded together at their mating edges to form the full round shell, and the headers are brazed to the shell and the tube end portions brazed to the headers. Coolant inlet and outlet end caps are secured to the ends of the shell, and oil or other fluid inlet and outlet connectors are secured to the sides of the shell adjacent the respective ends thereof. Hence oil or other fluid is caused to flow around the tubes and the baffles to be cooled by coolant passing through the tubes.

3 Claims, 4 Drawing Figures

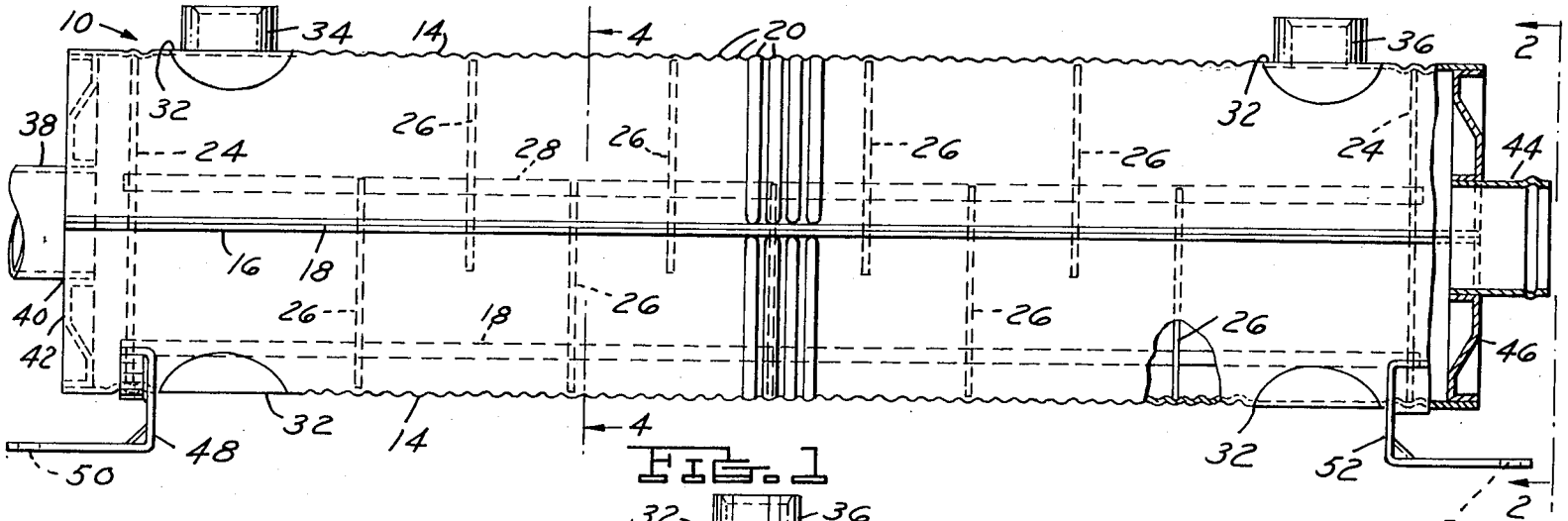
2
44
46
2
50
36
24
52
32
26
32
26
26
26
20
4
26
26
4
28
18
14
26
14
34
18
26
32
16
24
48
32
10
38
40
42
50
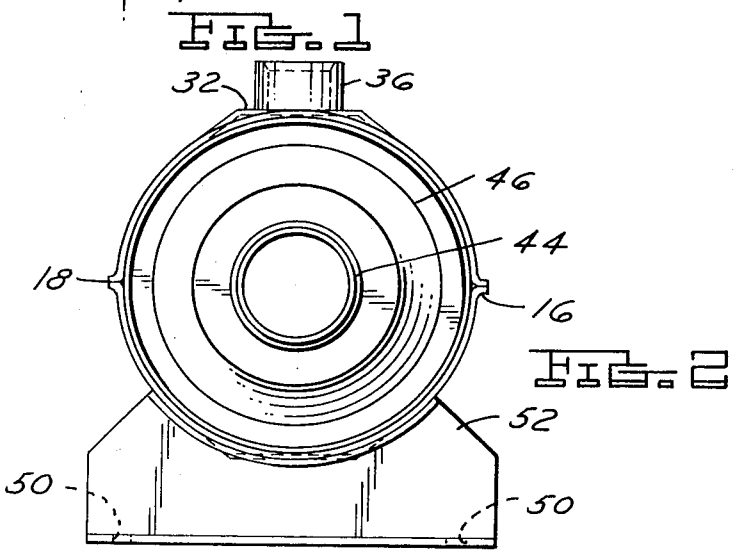
2
46
44
16
52
50
36
32
18
50

HEAT EXCHANGER AND METHOD OF ASSEMBLY THEREOF

TECHNICAL FIELD

This invention relates generally to heat exchangers of the shell and tube type and, more particularly to such heat exchangers wherein the outer wall consists of two corrugated half shells welded together at their seams, the corrugations serving as seats for the headers and baffles.

BACKGROUND ART

Heretofore, heat exchanger assemblies of the shell and tube type have generally consisted of a cylindrical shell into which a tube bundle assembly of headers, baffles and tubes brazed together is inserted and brazed around the headers adjacent the ends of the cylindrical shell.

DISCLOSURE OF THE INVENTION

A general object of the invention is to provide an improved heat exchanger assembly of the shell and tube type.

Another object of the invention is to provide an improved and more readily assembled heat exchanger assembly wherein the outer shell consists of two welded-together half shells, each having a corrugated wall.

A further object of the invention is to provide a heat exchanger assembly wherein a tube assembly of headers, baffles and tubes are positioned in one corrugated half shell, with the headers and alternate baffles seated in selected corrugations, after which the other corrugated half shell is seated on the headers and remaining baffles, and the adjacent edges of the half shell welded together prior to brazing the two headers to the surrounding shell.

Still another object of the invention is to provide an improved method for assembling such heat exchanger assembly.

These and other objects and advantages of the invention will be apparent when reference is made to the following description and accompanying drawings.

BRIEF DESCRIPTION OF THE DRAWINGS

FIG. 1 is a side elevational view of an oil cooler heat exchanger assembly embodying the invention;

FIG. 2 is an end view taken along the plane of the line 2—2 of FIG. 1, and looking in the direction of the arrows;

BEST MODE OF CARRYING OUT THE INVENTION

Figure 3:
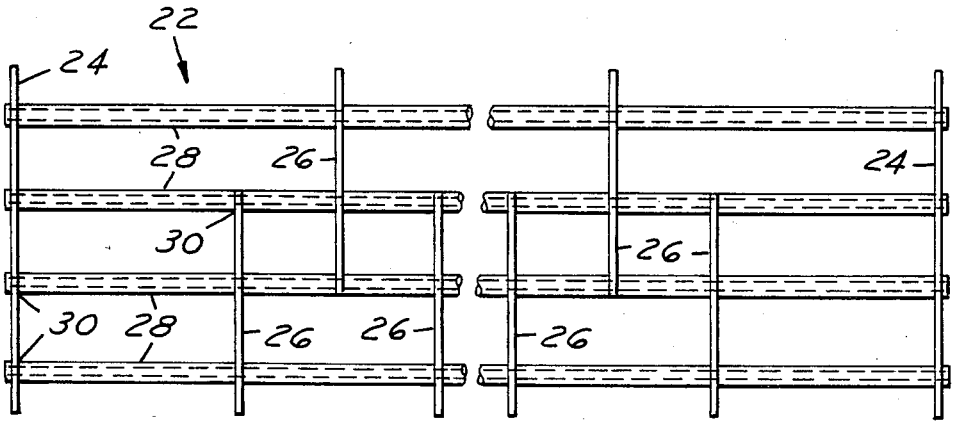
FIG. 3 is a side elevational view of the inner tube assembly portion of the FIG. 1 structure.
Figure 4:
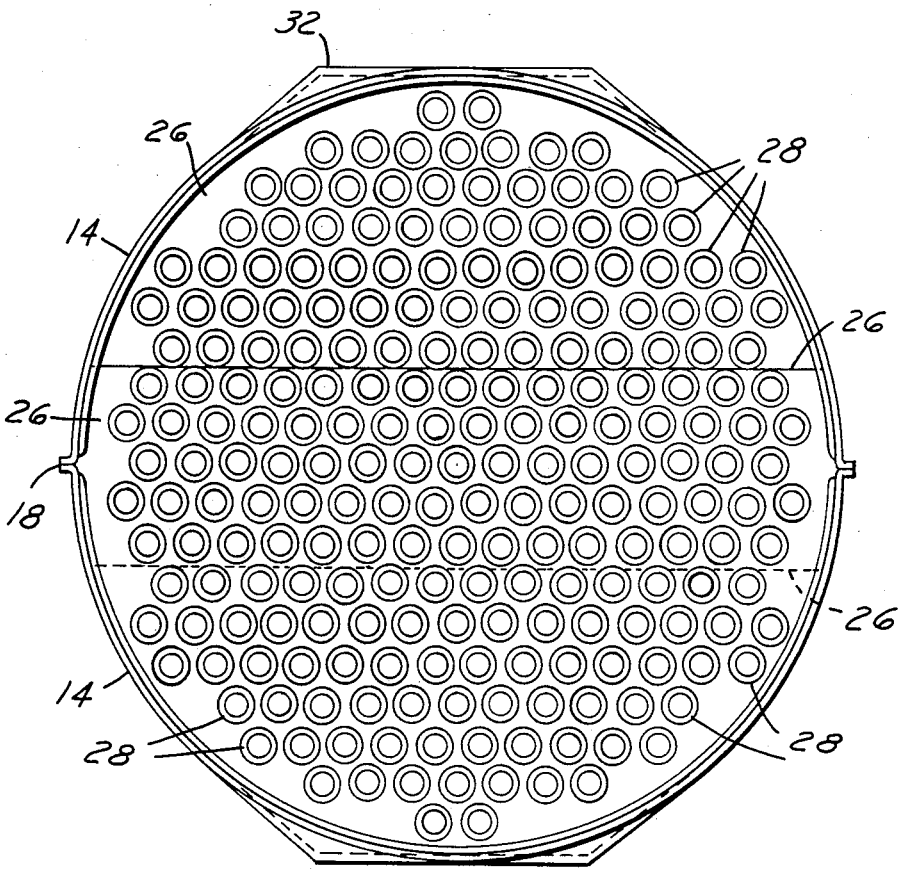
FIG. 4 is an end view taken along the plane of the line 3—3 of FIG. 2, and looking in the direction of the arrows.

Referring now to the drawings in greater detail, FIG. 1 illustrates a heat exchanger 10 of the shell and tube type, such as may be used as an oil cooler, wherein an outer shell 12 consists of two stampings serving as two symmetrical halves 14 welded together at their adjacent flanged edges 16 as seams 18 (FIG. 2). Each shell half 14 is formed to include closely spaced corrugations 20 along its full length with the exception of a predetermined short length at each end thereof. A tube bundle 22 (FIG. 3), consisting of two tube sheets or headers 24, a plurality of equally spaced, alternately positioned baffles 26, and a plurality of tubes 28 mounted through aligned openings 30 formed in the headers and baffles, is mounted in the full round shell 12 in a manner to be described. Connector means to be described are included for causing oil or other fluid to flow through the full round shell 12 intermediate the headers 24 around the tubes 28 and baffles 26, and for causing a suitable coolant, such as water to flow through the tubes 28.

As shown in FIGS. 1 and 3, the headers 24 are full round members, while the baffles 26 are slightly more than half round members.

The manufacture and assembly procedure for the heat exchanger 10 may be as follows:

1. Each half round shell half 14 is stamped out on a press (not shown) from flat sheet steel stock, forming the corrugations 20, along substantially the full length thereof, the flanged edges 16 and flat surfaces 32 adjacent the ends thereof, adaptable to having inlet and outlet fluid connectors 34 and 36, respectively, mounted thereon;

2. The perforated headers 24 and baffles 26 are inserted into respective arcuate grooves formed in a suitable assembly fixture (not shown), with alternate baffles being alternately disposed (FIG. 1);

3. The tubes 28 are inserted through the aligned openings 30 in the headers and baffles to complete the tube bundle 22;

4. A first half shell 14 is placed over the tube bundle such that the headers and baffles seat in selected corrugations 20, alternate baffles projecting outwardly therefrom;

5. The fixture and tube bundle are next turned over, the fixture removed, and the second half shell 14 placed thereon, such that the headers and baffles seat in selected corrugations thereof;

6. The assembly is thereupon placed in a suitable clamping fixture (not shown) to insure tight fitting flanged edges 16, and then welded to form the seams 18;

7. The tubes 28, wnich extend just beyond the respective headers 24, are brazed to the headers, and the headers are brazed to the full round shell 12, eliminating leakage from one side of the header to the other and securing the members in place as a unit;

8. An inlet fitting or end cap 38 is secured, as by welding, in an opening 40 formed in a circular mounting flange 42 and the latter flange, in turn, is secured, as by welding within one end of the shell 12, exterior the header 24. An outlet fitting or end cap 44 is likewise secured to another circular mounting flange 46 which is mounted within the other end of the shell 12. Hence, the inlet and outlet are in communication with each other via the intermediate open-ended tubes 28.

Thereafter a suitable mounting bracket 48, bearing two mounting slots 50, may be secured to the outer surface of the inlet end of the heat exchanger 10, and a second mounting bracket 52 may be secured to the outer surface of the outlet end.

As a variation of the above described assembly procedure, in lieu of steps 2, 4 and 5, one shell half 14 may be positioned open side up, without a holding fixture or with a simple cradle-type fixture, the headers 24 and the baffles 26 placed in the shell half, and finally the other shell half placed in position of the headers and baffles.

Once assembled, in operation, fluid enters through the inlet connector 34, over and around the tubes 28, but generally at right angles to the latter in view of having to contact and flow around the alternately, oppositely positioned baffles 26, and exits through the outlet connector 36, while water, or other coolant medium, flows through the tubes 28 via the inlet and outlet end caps 38 and 44, respectively. The two fluids are kept separate by the tight fit of the headers 24 in the end corrugations 20 of the full round shell 12.

INDUSTRIAL APPLICABILITY

It may be apparent from the above description that the corrugations 20: (1) add stiffness, permitting a reduction in shell wall thickness while eliminating any drawing-in of the shell during typical forming operations; (2) serve as positive spacers for the baffles, eliminating tacking or staking operations, as well as substantially reducing the possibility of the by-passing of oil therebetween which reduces cooling efficiency; and (3) reduce the gap between the shell and the headers, inasmuch as there need be no clearance provided for the insertion of a tube bundle into a cylindrical shell, as has heretofore been the case, substantially reducing the amount of brazing material required; thereby providing an efficient and more readily assembled oil cooler heat exchanger.

While but one apparatus embodiment and two assembly process embodiments of the invention have been shown and described, other modifications thereof are possible.

The embodiments of the invention in which an exclusive property or privilege is claimed are defined as follows:

1. A heat exchanger comprising two half circle shells, each having corrugated walls along substantially the full length thereof, said half circle shells being welded together at their mating edges to form a full round shell, a header mounted in the shell in the first corrugation adjacent each end thereof, a plurality of vertically-oriented baffles, each having an arcuate-shaped edge portion, with alternate baffles having their respective arcuate-shaped edge portions oppositely disposed in corrugations at equally spaced intervals within the welded half circle shells, a plurality of aligned openings formed in said headers and baffles, and a tube mounted through each series of aligned openings to form a tube bundle within said full round shell.

2. The heat exchanger described in claim 1, and inlet and outlet fluid connectors formed on said full round shell for controlling the flow of fluid through said full round shell around said tubes.

3. The heat exchanger described in claim 1, and inlet and outlet coolant caps secured to the ends of said full round shell for controlling the flow of coolant through said tubes within said full round shell.

* * * * *